United States Patent [19]

Lang

[11] 4,108,201

[45] Aug. 22, 1978

[54] SENSING PROBE FOR GRAVITY INDUCED FLOW LIQUID LEVEL REGULATOR

[75] Inventor: James R. Lang, Littleton, Colo.

[73] Assignee: The Mechanex Corporation, Denver, Colo.

[21] Appl. No.: 768,206

[22] Filed: Feb. 14, 1977

[51] Int. Cl.[2] ..... F16K 21/20

[52] U.S. Cl. ..... 137/393; 73/303; 137/453; 184/103 R

[58] Field of Search ..... 73/303 X; 137/393, 395, 137/453; 184/103 R, 105 R

[56] References Cited

U.S. PATENT DOCUMENTS

| | | | |
|---|---|---|---|
| 910,872 | 1/1909 | Simonides | 137/393 |
| 1,006,038 | 10/1911 | Wyllie | 137/393 |
| 1,071,894 | 9/1913 | Doss | 184/103 R |
| 1,175,869 | 3/1916 | Hueber | 184/103 R |
| 1,705,845 | 3/1929 | Woodman | 137/453 |
| 1,831,803 | 11/1931 | Dalrymple | 73/303 |
| 1,972,962 | 9/1934 | Weber | 137/453 |
| 2,252,026 | 8/1941 | Oettinger | 137/453 |
| 2,339,642 | 1/1944 | LeGro et al. | 137/453 |
| 2,342,480 | 2/1944 | Mosher et al. | 137/453 |
| 2,979,161 | 4/1961 | Lyden | 137/453 |

*Primary Examiner*—Martin P. Schwadron
*Assistant Examiner*—G. L. Walton
*Attorney, Agent, or Firm*—Thomas E. Torphy; James R. Hagen

[57] ABSTRACT

A liquid level sensing probe for gravity induced flow liquid level regulators used for maintaining a desired level of a liquid in a sump of a device having moving components within or adjacent the sump, such as maintaining a desired oil level in the crankcase of an engine, increases the accuracy of the regulator by being resistant to wind forces which impinge upon the liquid and gases entrained within the liquid.

15 Claims, 9 Drawing Figures

SENSING PROBE FOR GRAVITY INDUCED FLOW LIQUID LEVEL REGULATOR

BACKGROUND OF THE INVENTION

Gravity induced flow liquid level regulators adapted to maintain a desired liquid level in a liquid containing sump are generally comprised of an air tight, refillable liquid reservoir positioned above the sump, a liquid flow or supply conduit connected between a lower portion of the reservoir and the sump to conduct liquid to the sump and a gas flow or sensing conduit which terminates at one end in fluid flow communication with a gas, generally air, containing space above the liquid level in the reservoir and terminates at its other end at the desired level at which liquid is to be maintained within the sump.

Such liquid level regulators are essentially barometric systems in which the flow of liquid from the reservoir to the sump is controlled by the pressure differential existing between the atmospheric or air pressure exerted on the liquid in the sump and the air pressure present above the oil level in the reservoir.

In such regulators liquid can flow, induced by gravitational force, from the reservoir to the sump through the supply line as long as air can flow through the sensing conduit into the air containing space above the liquid level in the reservoir. When the liquid level in the sump is at the desired level the liquid covers and seals that end of the sensing conduit within the sump and prevents the flow of air to the reservoir. As liquid continues to flow through the supply line a partial vacuum is formed in the air containing space above the liquid in the reservoir. The liquid ceases to flow when the flow inducing gravitational force exerted on the liquid is equalized by the partial vacuum above the liquid, or, barometrically speaking, when the pressure differential between the air pressure on the surface of the liquid pool in the sump and the air pressure on the surface of the liquid in the reservoir equals the head of liquid in the supply line.

When the liquid level in the sump falls below its desired level the end of the sensing line is uncovered to enable air to flow to the reservoir, causing a decrease in the partial vacuum, i.e. an increase in air pressure, and a consequent flow of oil until the end of the sensing line is again sealed by the liquid. Thus, as long as the reservoir has liquid in it, the desired level of liquid is maintained in the sump.

Such regulators have long been used in attempts to maintain the oil in the crankcase of an engine at a desired level and much prior art effort has been expended to increase the accuracy of such regulators by decreasing false oil level sensings resulting from oil movement or slosh upon movement and tilting of engines, such as those in vehicles.

However, the inventor of this invention has discovered that many of the false oil level sensings of the air carrying conduits of such regulators result from violent gas or air currents caused by the moving components of the engine and/or by gases entrained in the oil, generally in the form of small bubbles.

BRIEF SUMMARY OF THE INVENTION

A sensing probe for a gravity induced flow fluid level regulator has a shield which enables the probe to sense an average liquid level at the probe tip. This average liquid level rarely exists in a steady manner due to the effects of violent gas or air currents present in a liquid containing sump of a device having internal moving components, such as the crankcase of an engine. The shield also aids in decreasing the undesirable effects of entrained gas or air bubbles, often present within the liquid, on accurate operation of the probe.

DETAILED DESCRIPTION OF THE INVENTION

Figure 1:
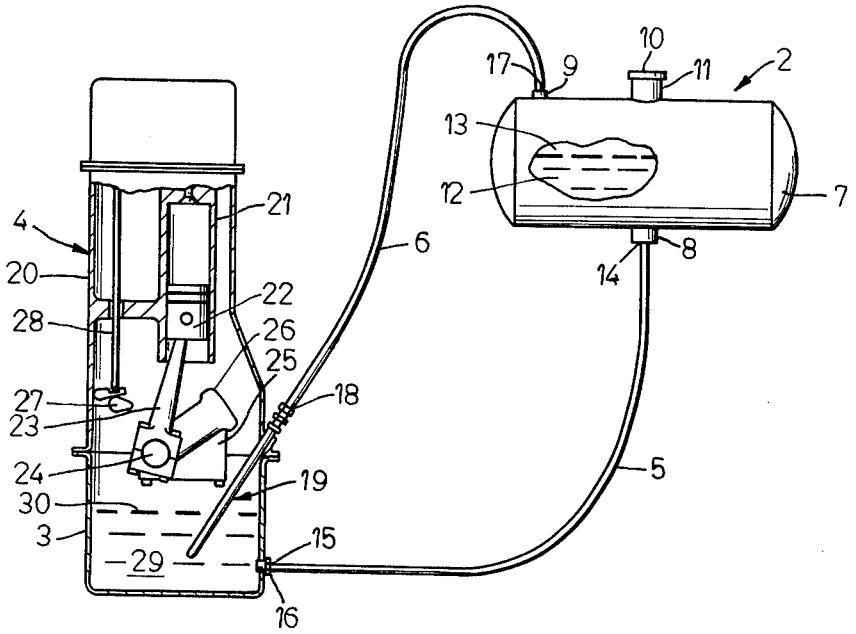
FIG. 1 shows an oil level regulator connected to the crankcase of a representative internal combustion engine and having the sensing probe of this invention.

FIG. 1 shows an air tight liquid level regulator reservoir 2 connected to a sump or crankcase 3 of a device having internally located moving components, such as representative internal combustion engine 4. The reservoir is connected to the crankcase by a liquid carrying means, such as supply conduit 5, and an air carrying means, such as sensing conduit 6.

Reservoir 2 is comprised of an oil containing tank 7 having an oil outlet fitting 8 to which supply conduit 5 is sealingly engaged and a gas carrying, generally air, fitting 9 to which sensing conduit 6 is sealingly engaged. A removable air tight cap 10 is, in normal operation of the regulator, sealingly engaged with an oil inlet fitting 11. Inlet fitting 11, upon removal of cap 10, enables replenishment of the oil within the tank.

As shown in the cutaway portion of the tank a quantity or pool of a liquid lubricant, such as oil 12, occupies the lower portion of the tank 7 and a gas, generally air 13, occupies the upper portion of the tank.

Supply conduit 5 is comprised of a first end 14 and a second end 15. End 14 is sealingly engaged with oil outlet fitting 8 of tank 7 and end 15 is sealingly engaged in fluid flow communication with the interior of crankcase 3 by means such as fitting 16.

Sensing conduit 6 has a first end 17 and a second end 18. End 17 is sealingly engaged with fitting 9 of tank 7 and end 18 is in fluid flow communication with the interior of crankcase 3 by being sealingly engaged with a sensing probe 19 of this invention.

Combustion engines such as representative engine 4 are typically comprised of an engine block 20 having one or more cylinders, such as cylinder 21. Each cylinder is occupied by a piston 22 subject to reciprocation longitudinally of the cylinder upon operation of the engine.

A piston rod 23 is pivotally connected to each piston and to a crank, such as crankshaft 24. Crankshaft 24 is supported for rotary motion by one or more main bearings 25 so that when piston 22 reciprocates within cylinder 21 crankshaft 24 is forced to rotate to transmit power to other devices, such as transmission, drive shafts etc. in a manner so well known no additional explanation is felt necessary.

Balancing devices, such as counter weights 26, are generally present on crankshafts to assure balanced, smooth rotary movement of the shaft. Also, typical engine construction provides a cam shaft 27 and valve push rods 28.

A pool of a liquid lubricant 29, generally oil, is provided to a desired level, such as 30, within crankcase 3. Oil 29 is pumped throughout the engine by a pump, not shown, to assure adequate lubrication of various moving components of the engine. It is important that the oil pool 29 be maintained at or close to the desired oil level 30 to prevent cavitation of the oil pump and consequent inadequate lubrication at a low oil condition or to prevent engine oil seal damage and consequent oil wastage if the oil is at too high a level.

The oil level regulator comprised of tank 7, conduits 5 and 6 and probe 19 serves to automatically maintain the oil at the desired level by replenishing oil consumed during operation of the engine.

Figure 2:
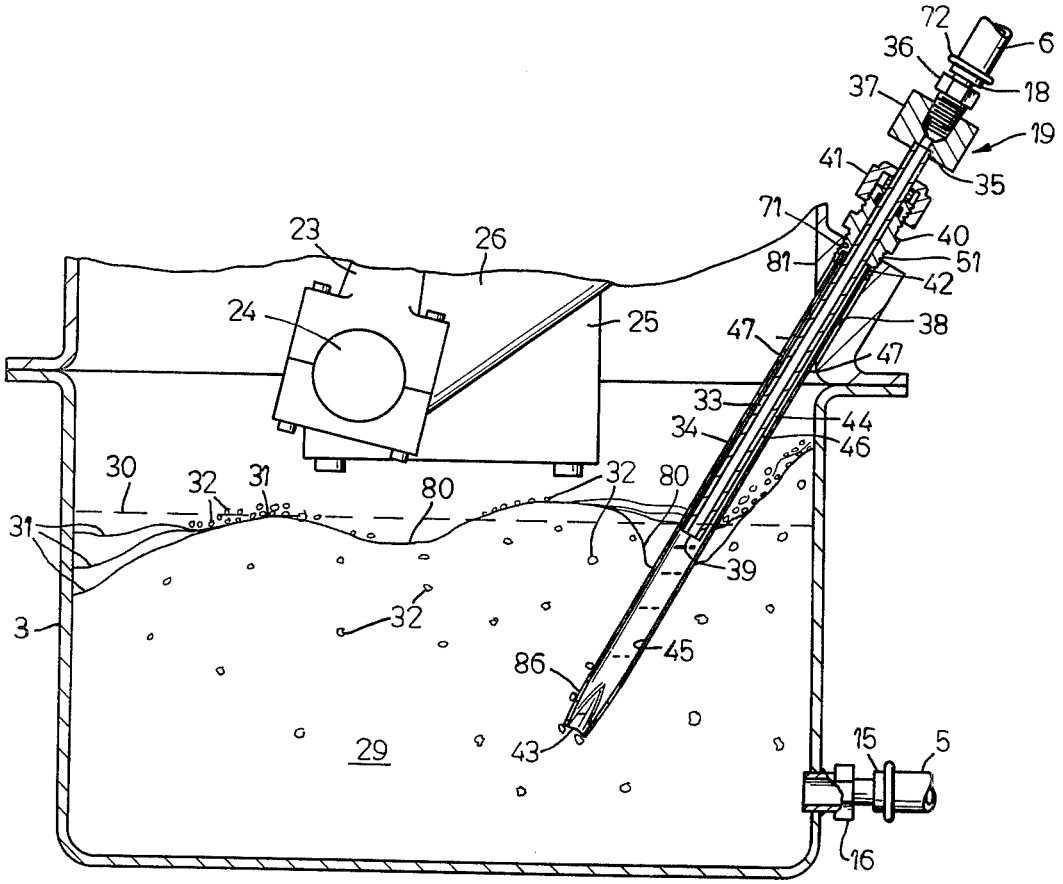
FIG. 2 is an enlarged partial view of the engine shown in FIG. 1, showing the sensing probe of FIG. 1 in enlarged detail.

FIG. 2 shows an enlarged partial view of the engine crankcase 3 and sensing probe 19 shown in FIG. 1, together with crankshaft 24, a main bearing 25 and counterweight 26 and a portion of a piston rod 23.

The pool of oil 29 as shown in FIG. 2 represents a typical condition when the engine is in operation and is shown having a rough, uneven surface 31, opposed to the normal oil level or surface 30 which would prevail when the engine is level and not in operation. During operation of the engine the crankshaft, piston rods and counterweights rotate at high speeds and each piston, such as piston 22 reciprocates at a high rate of speed. Additionally, periodic ignition and explosion of a fuel-air charge above the piston in each cylinder occurs and forces a quantity of gases, generally called blowby gases, between the cylinder wall and sealing rings on the piston and into the crankcase.

The rapid movement of the engine components together with the blowby gases cause a great deal of gas or air currents within the crankcase above the pool of oil 29. Due to the violent nature of these air currents the surface 31 of the oil 29 is generally in a constant state of agitation during operation of the engine and gases or air are forced into and entrained within the oil, generally in the form of a large number of bubbles 32. Entrained gas or air bubbles 32 may be entrained within oil pool 29 and also be present on the surface of the oil where they often tend to congregate and form a froth on surface 31.

Fitting 16 is sealingly engaged with a lower portion of the wall of crankcase 3 and the end 15 of supply conduit 5 is sealingly engaged with fitting 16 to provide fluid flow communication between oil pool 29 and the oil 12 in tank 7 as shown in FIG. 1.

Figure 3:
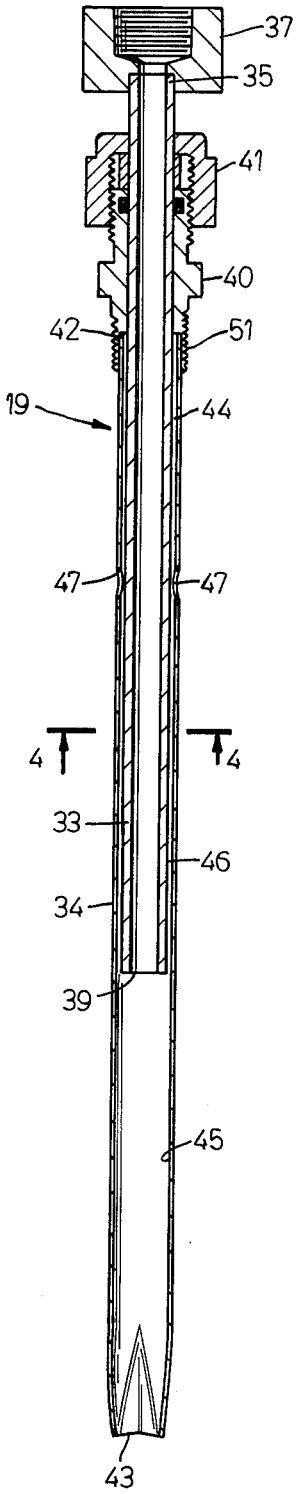
FIG. 3 is an enlarged view of the probe of FIG. 2 showing in detail the structure of the probe.

A sectioned view of sensing probe 19 of this invention is shown in FIG. 2, and in enlarged detail in FIG. 3. Sensing probe 19 is comprised of a sensing conduit termination member 33 and a sensing conduit shield 34. Sensing conduit 33 has a first end 35 which is sealingly engaged in fluid flow communication with end 18 of sensing conduit 6 by appropriate connective means such as fittings 36 and 37.

Probe 19 is introduced through an appropriate opening, such as opening 38, into the interior of crankcase 3 and a second end 39 of sensing conduit 33 terminates at that level, such as level 30, at which it is desired to maintain the top surface or mean level of oil pool 29. Appropriate position maintenance or securement means, such as threaded fittings 40 and 41 secure probe 19 within opening 38 and maintain end 39 of sensing conduit 33 at the desired level 30 within the crankcase. Sensing conduit shield 34 is mounted concentric with and fits over and envelopes sensing conduit 33. Shield 34 has a first end 41 rigidly engaged with fitting 40 and a second end 43 which extends a substantial distance beyond end 39 of sensing conduit 33 and is submersed a substantial distance within oil pool 29.

Figure 4:
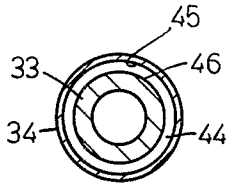
FIG. 4 is a sectioned view of the probe shown in FIG. 3, as indicated by convention.

As shown in FIG. 2, but more clearly shown in FIGS. 3 and 4, sensing conduit termination member 33 and shield 34 are preferably tubular members and sized relative to each other so that a longitudinal fluid flow passage, such as annular gap or space 44, is present between the internal surface 45 of shield 34 and the outer surface 46 of sensing conduit termination member 33.

As shown in FIGS. 2 and 3, vent means, such as holes 47, provide a fluid flow path between the longitudinal flow passage formed by annular space 44 and the gas or air occupied space above the surface 31 of oil pool 29 so that air can flow from the air space in the sump along passage or space 44 to end 39 of conduit 33.

Figure 5:
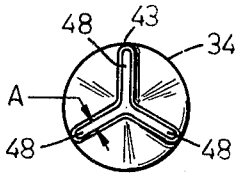
FIG. 5 is an end view showing the end configuration of the probe shown in FIG. 3.

FIG. 5 shows an end view of the preferred entrained gas bubble resisting trilobate slot or flow opening configuration of end 43 of shield member 34. End 43 is shown having three equally spaced fluid flow slots or openings 48 extending radially outwardly from the longitudinal axis 49 of shield 34. The distance acrossed each slot from a first side to a second side, as indicated by conventional dimension A, is preferably about 0.38mm (0.015 inch) but it is to be understood that larger or smaller slot widths are workable for resisting the entry of bubbles formed of entrained gases under certain conditions of oil temperature, oil viscosity and the amount and sizes of particulate materials in the oil in which the end is immersed. The slot width should be small enough to resist entrained gas bubble entry, yet large enough to allow oil to flow through and to not be susceptible to becoming plugged by an accumulation of sludge or particulate matter. The trilobal slot shown may be formed by forcing three equally spaced points of the tube wall defining open end 43 radially inwardly. Any slot having a plurality of lobes, i.e. a multilobal slot, such as a slot having four lobes, i.e. a quadlobal slot, may be used but as the number of lobes increase, especially above four, formation becomes increasingly difficult.

Figure 6:
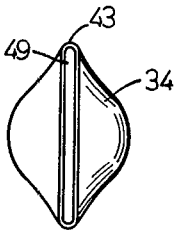
FIG. 6 is an end view showing an alternate end construction of a probe, such as shown in FIG. 3.
Figure 7:
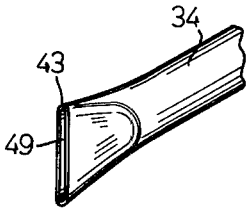
FIG. 7 is a perspective view of the probe end construction of FIG. 6.

FIG. 6 shows an alternate end configuration for a shield 34 in which a single fluid flow slot or opening 49, preferably about 0.38mm (0.015 inch) in width, is formed acrossed the end 43 of shield 34. FIG. 7 is a perspective view of the shield end configuration of FIG. 6 showing the narrow elongated fluid flow opening or slot 49. Slot 49 may be formed by compressing the tube together from two diametrically opposed points to provide the fantail effect shown.

The probe shown in FIG. 3 would normally be assembled at the factory and shipped with the end 39 of the sensing conduit termination member at a desired distance from threads 51 of member 40 to assure that when the probe is threadedly engaged with an appropriate opening, such as opening 38 of FIG. 2, for a particular engine, end 39 of member 33 will be at the desired oil level for that particular model of engine.

Figure 8:
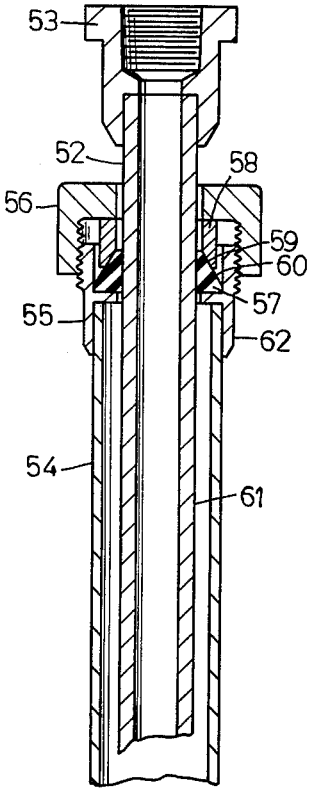
FIG. 8 is an enlarged detail view showing an alternate construction of the probe shown in FIG. 3.

FIG. 8 shows an alternate construction for a probe in which the sensing conduit termination member is readily adjustable relative to the probe shield. The probe of FIG. 8 has a sensing conduit termination member 52 sealingly engaged with an appropriate fitting, such as fitting 53, adapted for sealingly engaging a threaded fitting 36 shown on the end of sensing conduit 6 in FIG. 2. Shield member 34 is sealingly engaged with a fitting 55 which surrounds member 52. Cap member 56 is threadedly engaged with fitting 55 and an annular resilient seal means, such as frusto-conical seal member 57, and a rigid bushing member 58 are interposed between fitting 55 and cap 56. Bushing 58 has an angled surface 59 which engages a portion of radially outwardly facing surface 60 of resilient member 57. To adjust the end (not shown) of member 52 relative to fitting 55 to position the end at the desired oil level for a particular engine model cap 56 is loosened from fitting 55 and member 52 may be forced upwards or downwards relative to fitting 55. When the desired relationship between fitting 55 and the end of member 52 is achieved cap 56 is tightened on fitting 55 forcing bushing 58 to wedge a continuous annular portion of seal 57 radially inwardly to sealingly and frictionally engage an annular portion of the external surface 61 of member 52 for maintaining member 52 in the desired position relative to fitting 55. Member 55 may have a smooth cylindrical outer surface 62 for sliding engagement and insertion and removal into a smooth bore engine opening (not shown) or it may be provided with threads for threadingly engaging an opening such as opening 38 of FIG. 2. The probe of FIG. 8 would be provided with appropriate vent openings, such as the vent openings 47 of the probe shown in FIG. 3.

Relatively rigid probes, such as shown in FIG. 3, are normally used for applications where a great number of probes are made for a particular widely used engine. Adjustable probes, such as shown in FIG. 8 would normally be produced to accommodate a variety of different engines and custom applications due to the fact that any one of the applications would not likely offer sufficient sales volume to justify a probe built specifically for it.

Figure 9:
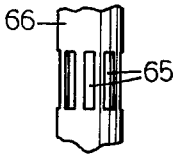
FIG. 9 is a fragmentary view showing an alternate construction of vents used in the probe.

FIG. 9 shows an alternate vent opening construction in which the vent openings 65 in a shield wall 66 are comprised of a series of elongated openings or slots.

In FIG. 2 the probe 19 shown is a relatively fixed level probe, as shown in enlarged detail in FIG. 3. Installation of the probe is accomplished by inserting end 43 into opening 38 and pushing the entire assembly inward until the threads 51 engage the threads 71 of opening 38. The probe is then torqued into a relatively rigid position, as shown, and conduit 6 is sealingly engaged with fitting 18 and maintained there by suitable means, such as clamp 72.

At rest in a level position the oil level would normally be at desired oil level 30. Consequently, end 39 of sensing conduit 33 would be sealed and no oil would flow into crankcase 3 via supply conduit 5.

However, when the engine is operating and level an uneven oil level, as typified by lines 31, would at a given instant, likely represent the true top surface of the oil pool 29. As the oil is subjected to continual agitation from localized windages the surface of the oil pool is continually changing. A great variety of surface anomalies, such as the depression represented by line 80, may be present on surface 31. These surface anomalies may be fairly constant, periodic, or random and sporadic in occurrence depending upon the cause of the depression.

For instance, if the depression is caused by blowby gases from a cylinder with bad piston rings and occurs each time that cylinder undergoes a power stroke, the depression would be periodic and, without shield 34 to protect end 39 of sensing conduit 33, the blowby gases would essentially "pump" air into the sensing conduit until the crankcase was overfull to the extent that the blowby gases were unable to force the oil away from sensing conduit end 39.

Even if such surface anomalies are transient and random in occurrence they will likely cause some overfilling, particularly over extended periods of engine operation.

Also, if a surface anomaly, such as a higher than mean level surface adjacent the probe, such as shown on either side of depression 80, occurs at the probe tip, by phenomena such as described above, the probe end 39 would be covered when the actual oil level is below the desired mean oil level and the crankcase would be undesirably underfull.

Probe 19 reduces the effects of such surface anomalies as shield 34 completely envelopes and surrounds sensing conduit 33 and extends from fitting 40 to a substantial distance beyond sensing conduit end 39 into oil pool 29 to terminate at end 43 in a relatively calm portion of oil pool 29, relative to the agitated surface 31. Oil 29 is free to enter shield 34 through end 43 and rises to the mean oil level, such as level 30, within shield 34 to seal end 39 of sensing conduit 33. Due to the depth at which end 43 of shield 34 is immersed into oil pool 29 the windages agitating the surface have little effect upon the oil at that level. The depth to which end 43 of shield 34 is immersed within pool 29 is dependent on the degree of agitation of the oil. It should at least be immersed to a depth below the depth of the severest low level surface anomaly expected within an engine to assure that end 43 is always immersed in oil. Therefore, the oil level present within the shield of the probe will generally be substantially representative of the true mean oil level within the crankcase.

Vents 47 are provided to enable the oil level within the shield of the probe to rise to the true oil level by preventing the presence of either a high or low pressure condition within the annular gap which extends longitudinally of the probe between the sensing conduit and the shield. Also, the air which flows to the reservoir to break the partial vacuum in the reservoir flows from the air space in the crankcase through vents 47, down longitudinal annular space or gap 44 through the end 39 of conduit 33 and through conduit 6 to the reservoir.

Vents 47 are preferably placed in a portion of the probe shield substantially above the mean oil level 30 to keep them substantially free of oil. In some applications it is preferable to locate the vents close to the wall 81 defining the sump. At least two diametrically opposed openings, as shown in FIGS. 2 and 3, is preferred.

Placement of the vents relatively close to the sump wall aids in decreasing the chances of a windage or air current in the crankcase from impinging directly on a vent or vents. Providing a pair of diametrically opposed vents decreases the effect such a windage, or any windage, would have in tending to depress or raise the oil level within the probe shield. A pressure windage impinging on a vent will tend to escape out the opposite vent and thus any tendency of the windage to force the oil away from conduit end 39 will be decreased. A windage impinging upon a vent in such a manner as to place a negative pressure on longitudinal fluid flow space or gap 44 will pull in gases through the opposing vent and thus be less likely to draw the oil in the probe up to a false level. Alternating positive and negative pressure windages would have a tendency to cause the liquid level to rise and fall within the shield. The opposed vents eliminate or decrease such rising and falling to an acceptable level.

The vents formed of a series of slots as shown in FIG. 9 are an acceptable alternate form of windage effect resistant venting which may be used in many applications.

Quantities of gases and air are often entrained within the oil pool 29 as bubbles, as represented by bubbles 32. In conventional unprotected probe ends these bubbles can congregate at the probe end and periodically form larger bubbles within the sensing conduit and travel up conduit 6 to enable oil to flow to the crankcase to eventually cause an overfull condition.

By having narrow flow slots or openings 48, as shown in FIG. 5, formed in the end 43 of shield member 34 many of the bubbles contacting the edges of the slots travel up the edge of the slot toward the upper external surface 86, see FIG. 2, of the shield member and rise to the surface and are thereby excluded from the sensing conduit end 39.

The trilobal configuration of FIG. 5 is preferred as, regardless of the orientation of the tube end 43 at least one of the slots will be oriented at an angle having a vertical component relative to the mean oil level and bubbles tend to travel along the slot upward and upwardly along the external surface of the shield.

The fantail slot of FIGS. 6 and 7 is an acceptable alternate form of bubble resistant flow opening but it would be possible by random chance to install a probe in which the slot would be oriented substantially parallel to the mean oil level which would tend to reduce the upward mobility of gas bubbles contacting it.

It is to be understood that sensing probes as herein taught may be advantageously used on a variety of devices having moving components in fluid flow communication with a sump, such as pumps and bearing journal boxes.

I claim:

1. In a sensing conduit for a gravity induced flow liquid level regulator, said sensing conduit having a first end adapted for being sealingly connected to fluid flow communication with a liquid reservoir and a second end being open and being adapted for extending into a liquid containing sump and having position maintenance means for maintaining said second end at a desired level within said sump and for maintaining said first end at a level above said second end, the improvement comprising:

a tubular shield surrounding said open end of said sensing conduit and a portion of said sensing conduit above said open end of said sensing conduit, said shield further extending a substantial distance beyond said open end of said sensing conduit and terminating in an end having a liquid flow passage, said end of said shield having said liquid flow passage being adopted for being immersed a substantial distance into a pool of liquid in said sump when said open end of said sensing conduit is maintained at the desired level in said sump for enabling said liquid in said sump to flow into and out of said shield;

means for maintaining said shield and said sensing conduit in fixed position relative to each other; and a longitudinal fluid flow passage formed between an exterior surface of said sensing conduit and an interior surface of said shield, said longitudinal fluid flow passage extending upwardly from said open end of said sensing conduit and vent means in said shield for placing said longitudinal fluid flow passage in fluid flow communication with an air space above said liquid in said sump for enabling air to flow through said vent means and said longitudinal fluid flow passage to said open end of said sensing conduit.

2. The invention as defined in claim 1 in which said vent means is comprised of two openings and one of said openings is disposed on a side wall portion of said shield opposite another side wall portion of said shield for enabling air forced into said shield through one of said openings to flow out of said shield through the other of said openings.

3. The invention as defined in claim 1 in which said vent means is comprised of a series of slots formed in an annular portion of said shield.

4. The invention as defined in claim 1 together with gas bubble entry resistance means in said liquid flow opening in said lower end of said shield for offering resistance to the entry of gas bubbles into said shield.

5. The invention as defined in claim 4 in which said gas bubble entry resistance means is comprised of a narrow, elongated fluid flow opening defined by portions of said shield being forced toward each other.

6. The invention as defined in claim 5 in which said narrow fluid flow opening is multilobal.

7. The invention as defined in claim 1 in which that portion of said sensing conduit extending into said sump is a rigid tube and said shield is a rigid tube larger in diameter than said sensing conduit and said shield is maintained concentric with said sensing conduit rigid tube portion and an annular space between said exterior surface of said sensing conduit and said interior surface of said shield serves as said longitudinal fluid flow passage.

8. In a gravity induced flow liquid level regulator for maintaining a liquid lubricant at a desired level within an engine crankcase, said regulator having an air tight reservoir for containing liquid lubricant, said reservoir being positioned at a higher level than said crankcase for enabling gravity induced flow from said reservoir to said crankcase, a liquid lubricant supply conduit for carrying liquid lubricant from said reservoir to said crankcase and air carrying means having a first termination maintained within said crankcase at the desired level at which liquid lubricant is to be maintained in said crankcase and a second termination connected to said reservoir at a position above the liquid level in said reservoir for enabling air to flow to said reservoir when said first termination of said air carrying means is not sealed by said liquid lubricant in said crankcase, an improved first termination for said air carrying means comprising:

a first rigid tubular member extending through an opening in a wall adjacent said crankcase, said first tubular member having a first end positioned outside of said crankcase and sealingly engaged in fluid flow communication with an air containing space in said liquid reservoir, and a second end fixedly positioned within said crankcase at the desired level at which liquid lubricant is to be maintained within said crankcase, said first end of said tubular member being positioned above the level at which said liquid lubricant is to be maintained in said crankcase;

position maintenance means substantially rigidly engaged with a peripheral portion of said first tubular member intermediate said first and said second end of said first tubular member for maintaining said first tubular member in a substantially fixed position relative to said opening;

a second rigid tubular member surrounding said second end of said first tubular member and extending toward said first end of said first tubular member for surrounding a portion of said first tubular member contiguous to said second end of said first tubular member, said second tubular member terminating in a first end above the desired liquid level in said crankcase, said second tubular member further extending substantially beyond said second end of said first tubular member and terminating in a second end positioned substantially below the desired liquid lubricant level in said crankcase;

a longitudinal fluid flow passage formed between an exterior surface of said first tubular member and an interior surface of said second tubular member and extending from said second end of said first tubular member toward said first end of said second tubular member;

fluid flow means in said second tubular member for enabling fluid flow between an air space above said liquid level in said crankcase and said second end of said first tubular member through said longitudinal fluid flow passage for enabling air to flow from said air space to said second end of said first tubular member and for enabling air to flow from said longitudinal passage into said air space; and said second end of said second tubular member having a fluid flow opening for enabling liquid lubricant to enter said second tubular member to seal said second end of said first tubular member when said oil is at its desired level.

9. The invention as defined in claim 8 in which said fluid flow means in said second tubular member is comprised of two openings in said second tubular member, each of said openings being located on an opposite side of said tubular member for enabling fluid flow entering one of said openings to at least partially exit through said other of said openings for decreasing the ability of air currents to effect the level at which oil is present in said second tubular member.

10. The invention as defined in claim 8 in which said fluid flow means in said second tubular member is comprised of a series of elongated fluid flow openings formed in an annular portion of said second tubular member.

11. The invention as defined in claim 8 together with means for resisting entrance of gas bubbles into said second tubular member placed in said open second end of said second tubular member.

12. The invention as defined in claim 11 in which said means for resisting entrance of gas bubbles is comprised of a fluid flow space defined by portions of said tubular member being spaced from each other for resisting entrance of said bubbles into said second tubular member.

13. The invention as defined in claim 12 in which said fluid flow space is a trilobal slot.

14. The invention as defined in claim 12 in which said fluid flow space is one straight elongate slot.

15. The invention as defined in claim 8 in which said first tubular member is slideably adjustable within said position maintenance means for rendering said first termination of said air carrying means adjustable to different levels.

* * * * *